US005733139A

United States Patent [19]

Bray et al.

[11] Patent Number: 5,733,139

[45] Date of Patent: Mar. 31, 1998

[54] SNAP-TOGETHER WIRE SPLICE

[75] Inventors: Douglas R. Bray, Medford, N.J.; Michael M. Strazhnik, deceased, late of Philadelphia, Pa., by Cecilia Straznik, executor

[73] Assignee: Sea Gull Lighting Products, Inc., Riverside, N.J.

[21] Appl. No.: 621,921

[22] Filed: Mar. 26, 1996

[51] Int. Cl.[6] ..... H01R 4/24

[52] U.S. Cl. ..... 439/402

[58] Field of Search ..... 439/402, 403, 439/404, 405, 406, 407, 425, 427, 389, 392, 393, 395, 396

[56] References Cited

U.S. PATENT DOCUMENTS

| | | | |
|---|---|---|---|
| 2,779,842 | 1/1957 | Walker | 439/425 X |
| 3,835,444 | 9/1974 | Plana et al. | 439/392 |
| 4,834,668 | 5/1989 | Markwardt | 439/392 |
| 4,988,311 | 1/1991 | Tanzola | 439/404 |
| 5,199,899 | 4/1993 | Ittah | 439/403 |
| 5,321,592 | 6/1994 | Marinacc | 362/226 |
| 5,567,173 | 10/1996 | Franckxx | 439/404 |

FOREIGN PATENT DOCUMENTS

| | | | |
|---|---|---|---|
| 8502512 | 5/1986 | Netherlands | 439/402 |
| 1030105 | 5/1966 | United Kingdom . | |

*Primary Examiner*—Gary F. Paumen
*Assistant Examiner*—Tho Dac Ta
*Attorney, Agent, or Firm*—Seidel, Gonda, Lavorgna & Monaco, PC

[57] ABSTRACT

The invention relates to a device for electrically connecting wires. The device includes first and second nonconductive housing sections adapted to be mateably secured together to form a substantially closed housing. An electrically conductive contact is disposed within the housing and has a first end including a tang for piercing the insulation of the first wire and making electrical contact with the center conductor thereof, a second end including a tang for piercing the insulation of the second wire and making electrical contact with the center conductor thereof, and a connecting portion electrically connecting the first end and the second end to provide an electrical path from the center conductor of the first wire through the contact to the center conductor of the second wire. At least one boss is located in the housing for pressing the ends of the first and second wires against the tangs of the electrically conductive contact when the housing sections are mated to one another sufficient to cause the tangs to pierce the insulation and make electrical contact with the center conductors and to secure the ends within the housing.

20 Claims, 4 Drawing Sheets

SNAP-TOGETHER WIRE SPLICE

FIELD OF THE INVENTION

The invention relates to an electrical connecting device for electrically connecting two lengths of insulated two conductor wire and two-lengths of uninsulated single conductor wire.

BACKGROUND OF THE INVENTION

Snap-together type electrical connecting devices which electrically connect two lengths of insulated conductor wire are known in the art. These devices enable one who is not a skilled electrician to splice two lengths of insulated wire, such as that found on many common household appliances and lighting fixtures.

Previously, splicing had to be done by an electrician or the like who stripped the insulation from the ends of the wire, twisted the wires together, and wrapped electrical tape around the exposed connection. As should be appreciated, this method is rather time consuming and involves some degree of skill.

Prior snap-together type electrical connecting devices were typically limited to applications that required joining only two lengths of single or two conductor insulated wires, and could not be used in application which had an additional uninsulated wire, such as a ground wire, which also needed to be spliced.

There is a need for a connecting device that can accommodate not only two-conductor wires, but single conductor wires as well, and which is easy to use and requires no special skills to install.

SUMMARY OF THE INVENTION

The present invention solves this need by providing a device for electrically connecting wires. The device includes first and second nonconductive housing sections adapted to be mateably secured together to form a substantially closed housing. A first opening is provided in one of the housing sections in communication with the exterior of the housing for receiving an end of a first insulated wire and a second opening is provided in communication with the exterior of the housing for receiving an end of a second insulated wire.

An electrically conductive contact is disposed within the housing and has a first end including a tang for piercing the insulation of the first wire and making electrical contact with the center conductor thereof, a second end including a tang for piercing the insulation of the second wire and making electrical contact with the center conductor thereof, and a connecting portion electrically connecting the first end and the second end to provide an electrical path from the center conductor of the first wire through the contact to the center conductor of the second wire. At least one boss is located in the housing for pressing the ends of the first and second wires against the tangs of the electrically conductive contact when the housing sections are mated to one another sufficient to cause the tangs to pierce the insulation and make electrical contact with the center conductors and to secure the ends within the housing.

A third opening can be provided in one of the housing sections in communication with the exterior of the housing for receiving an end of a first uninsulated wire and a fourth opening in communication with the exterior of the housing for receiving an end of a second uninsulated wire. A fifth opening is provided in the housing section in communication with both the third and fourth openings for receiving therein an electrically conductive contact having a first end including a tang for making electrical contact with the first uninsulated wire, a second end including a tang for making electrical contact with the second uninsulated wire, and a connecting portion electrically connecting the first end and the second end to provide an electrical path from the first uninsulated wire through the contact to the second uninsulated wire.

A plurality of ribs can be formed on the sidewalls of each channel for frictionally engaging a wire located in the channel.

At least one protrusion can extend from one of the housing sections and at least one recess can be formed in the other housing section, each recess is adapted to receive one of the protrusions for aligning the first and second housing sections.

The housing sections can further comprise cooperative interengaging detents integral therewith for mateably securing the first and second housing sections together.

BRIEF DESCRIPTION OF THE DRAWINGS

Additional features and advantages of the invention will become apparent to those skilled in the art upon consideration of the following detailed description of the preferred embodiment exemplifying the best mode of carrying out the invention as presently perceived. The detailed description particularly refers to the accompanying drawings.

DETAILED DESCRIPTION OF THE PREFERRED EMBODIMENT

Figure 1:
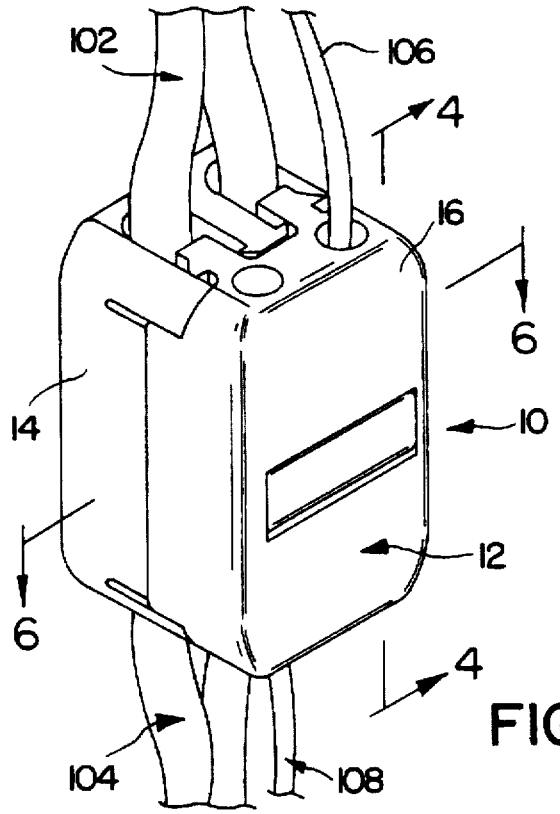
FIG. 1 is a perspective view of an embodiment of the electrical connector of the present invention.
Figure 2:
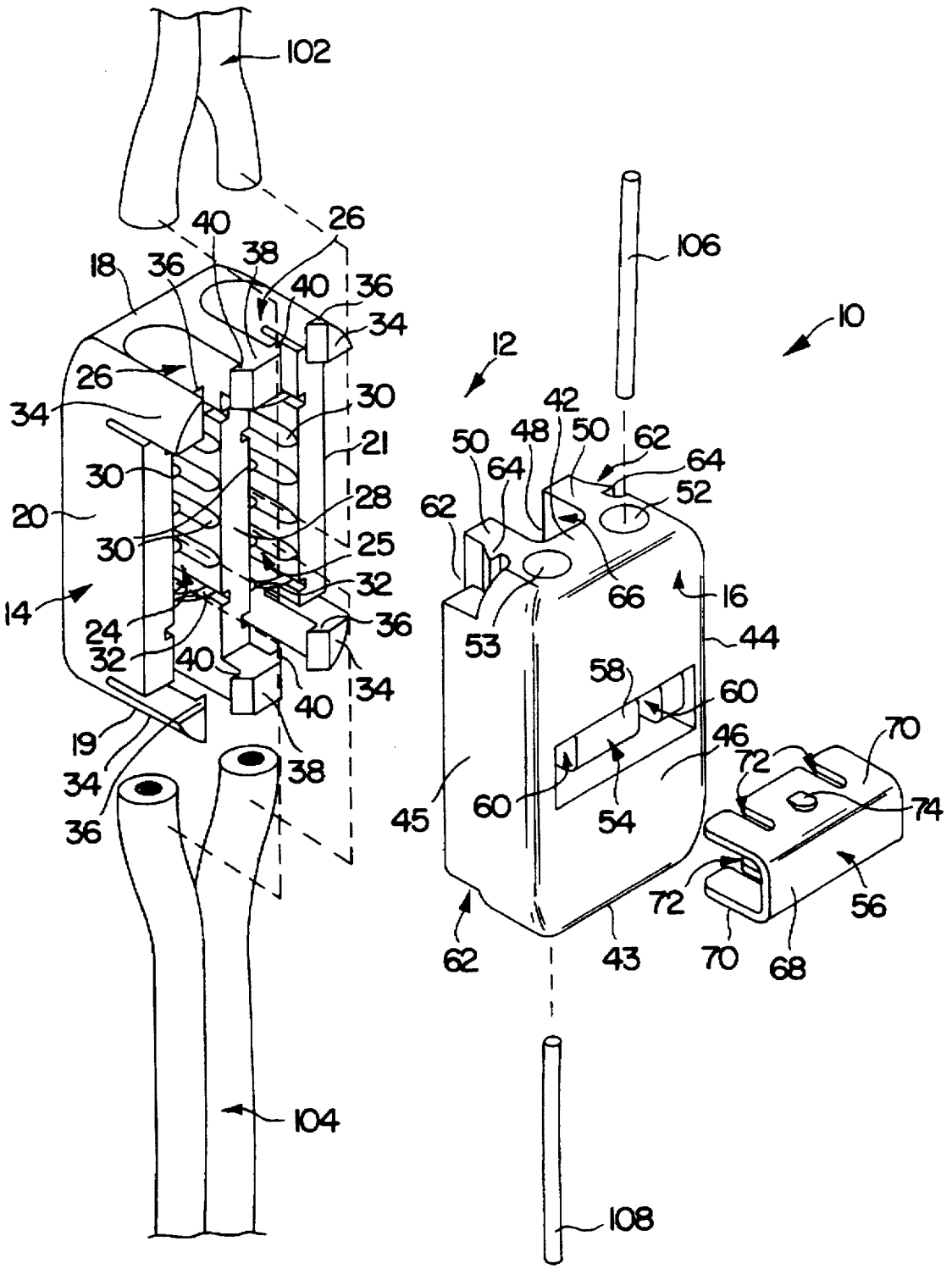
FIG. 2 is an exploded view of the electrical connector.

The present invention is directed to a snap-together wire splice for electrically connecting two lengths of insulated two conductor wire and two-lengths of uninsulated single conductor wire. With reference to the drawings, and particularly FIGS. 1 and 2, a snap-together wire splice 10 is shown connecting a first length of insulated two conductor wire 102 to a second length of insulated two conductor wire 104 and a first length of uninsulated single conductor wire 106 to a second length of uninsulated single conductor wire 108.

As seen in FIGS. 1 and 2, the wire splice 10 includes a housing 12 having a first section 14 and a second section 16. Typically, the housing 12 is formed from a non-conductive material, such as polycarbonate. In the embodiment shown, the housing 12 has a generally rectangular shape with rounded corners so that the housing fits easily in a chain.

First and second housing sections 14 and 16 are matingly engageable with each other and are dimensioned to surround the lengths of wire 102 and 104 and effect a spliced connection therebetween. In the embodiment shown, each section 14 and 16 has been separately formed by a molding process. Of course, the housing sections could be formed by any suitable process known to those skilled in the art.

Figure 6:
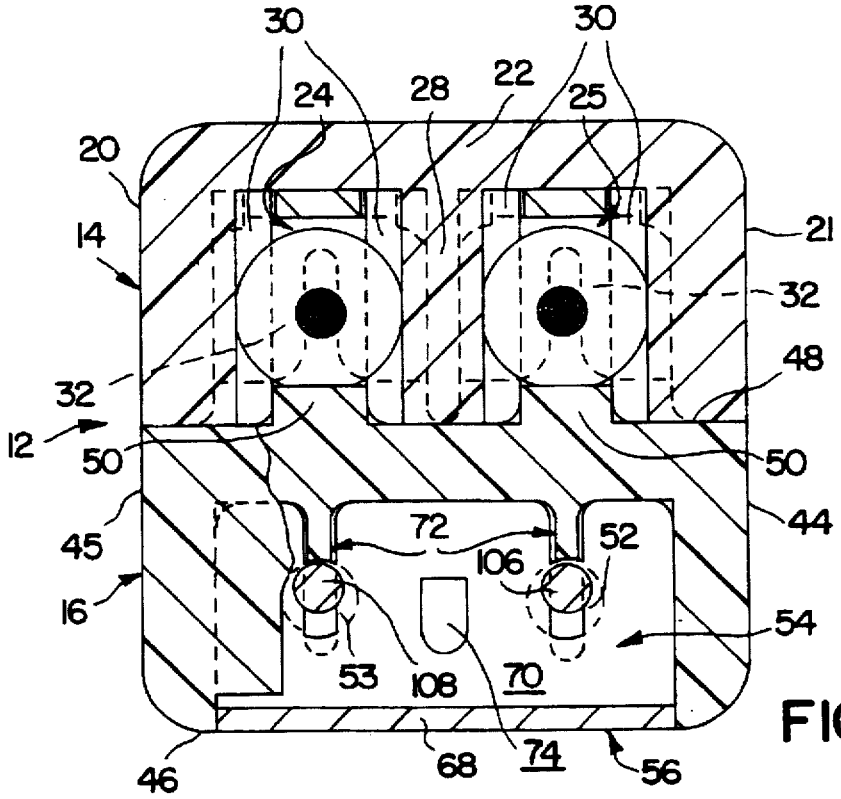
FIG. 6 is a cross-sectional view taken along line 6—6 of FIG. 1.

As best seen in FIG. 2, the first housing section 14 includes a pair of end walls 18 and 19 and a pair of sidewalls 20 and 21 extending from a base wall 22 (FIG. 6). The first housing section 14 includes a pair of longitudinal channels 24 and 25 extending parallel to and between the sidewalls 20 and 21. The channels 24 and 25 extend through the end walls 18 and 19, forming openings 26 therein. In the embodiment shown, openings 26 are provided with rounded bottom portions which extend approximately ⅛"–3/16" within the housing. The channels 24 and 25 have a rectangular cross-sectional shape in the embodiment shown; however, it is understood that the channels can have any cross-sectional shape capable of receiving an insulated wire.

The channels 24 and 25 are separated by a central wall 28 which extends the length of the first housing section 14. A plurality of transverse ribs 30 are provided along the length of the inner surfaces of sidewalls 20 and 21 and on both sides of central wall 28. The top wall 30*a* and apex 30*b* of each rib 30 are rounded to allow an insulated conductor to be placed within channels 24 and 25 between the apices 30*b* of the ribs 30 on opposite sidewalls of channels 24 and 25 without inadvertently piercing the insulation on the conductors. The distance between the apex 30*b* of each rib 30 located on opposite sidewalls of channel 24 and 25 is slightly smaller than the diameter of the insulated conductors to be received within channels 24 and 25 for frictionally engaging the insulated conductors.

An electrical contact 32 is also disposed in each channel 24 and 25 for receiving and electrically connecting the two lengths of insulated conductors located within each channel.

The corners of the first housing section 14 extend perpendicular to the base wall 22 to form generally rectangular upstanding retaining members 34. An outwardly protruding triangular detent 36 is located at the distal end of each upstanding retaining member 34. The end walls 18 and 19 extend transversely at each central wall 28 to form an upstanding retaining member 38. Outwardly protruding triangular detents 40 are located on opposite sides of each upstanding retaining member 38.

The second housing section 16 has a generally rectangular shape and includes a pair of end walls 42 and 43, a pair of sidewalls 44 and 45, an outer wall 46, and an inner wall 48. The second housing section 16 has a pair of longitudinal bosses 50 formed on the inner wall 48 extending parallel to and between the sidewalls 44 and 45. The bosses 50 are dimensioned and positioned to align with and fit within the channels 24 and 25 when the first and second housings 14 and 16 are attached.

A pair of longitudinal bores 52 and 53 are formed in the second housing section 16 and extend parallel to and between the sidewalls 44 and 45. The bores 52 and 53 open onto each end wall 42 and 43 and are dimensioned to receive an uninsulated wire. The bores 52 and 53 have a circular cross-sectional shape in the embodiment shown; however, it is understood that the bores can have any cross-sectional shape capable of receiving an uninsulated wire.

Figure 4:
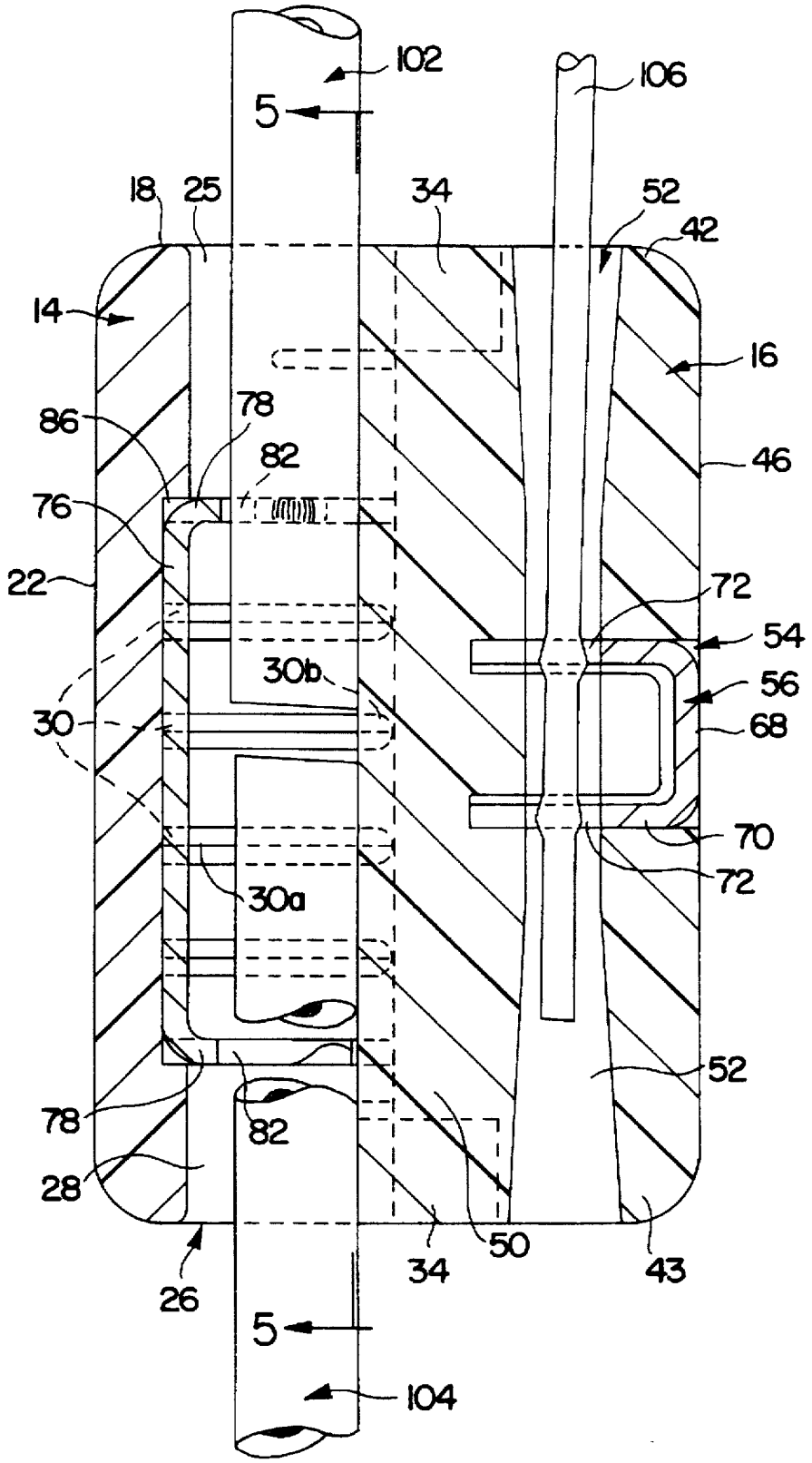
FIG. 4 is a cross-sectional view taken along line 4—4 of FIG. 1.

An inverted U-shaped cavity 54 is formed in the outer wall 46 of the second housing section 16 transverse to the bores 52 and 53. The cavity 54 is shaped to receive a generally U-shaped contact member 56 therein. The cavity 54 includes a medial protrusion 58 which extends from the inner wall of the cavity 54. The U-shaped cross-section of the cavity 54 is best seen in FIG. 4. A pair of slots 60 are formed in the medial protrusion 58. Each slot 60 is aligned with one of the longitudinal bores 52 and 53 and has a rounded bottom wall (not shown) for receiving a cylindrical wire.

A rectangular recess 62 is formed at each corner of the second housing 16. Each recess 62 is dimensioned to receive one of the upstanding retaining members 34 when the housing sections 14 and 16 are mated. Each recess 62 includes a triangular detent 64 which is complementary with the detent 36 on a respective upstanding retaining member 34. The detents 36 and the detents 64 cooperatively engage each other when the housing sections 14 and 16 are pressed together and function to secure the housing sections in a mated condition.

A groove 66 is formed in each end wall 42 and 43 (only one shown) between the longitudinal bosses 50. Each groove 66 receives one of the members 38 when the housing sections are mated. Each groove 66 is dimensioned to receive the detents 40 on member 38. The members 38 and the grooves 66 ensure that the housing sections 14 and 16 are properly aligned before they are attached together (See FIG. 1).

The contact member 56 includes an elongated base portion 68 and a pair of sidewall portions or tangs 70 extending therefrom and forming substantially a U-shape. A pair of aligned slots 72 are formed in each sidewall portion 70. Each slot 72 has angled edges for ensuring good electrical contact with the uninsulated wire. A protruding barb 74 having sharpened surfaces is formed on each sidewall portion 70 between the slots 72 (only one shown). The barbs 74 serve to prevent the contact member 56 from being removed from the cavity 54 after they are placed therein by embedding themselves into the sidewalls of the cavity 54. Typically, the contact member 56 is plated with a corrosion resistant conductive material, such as hard brass or a phosphor bronze nickel.

When the contact member 56 is placed within the cavity 54, the base portion 68 is adjacent the top wall of the medial protrusion 58. Each pair of slots 72 is aligned with one of the bores 52 and 53 and one of the slots 60 so as to engage an uninsulated wire located therein.

Figure 3:
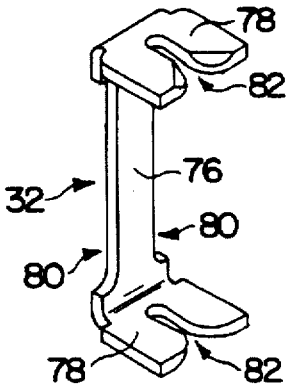
FIG. 3 is a perspective view of an electrical contact member according to an embodiment of the present invention.

The contact member 32 is shown in FIG. 3. The contact member 32 includes an elongated base portion 76 and a pair of end wall portions or tangs 78 extending transversely therefrom. An elongated notch 80 is formed in each side of the base portion 76. Each end wall portion 78 is provided with a slot 82. Each slot 82 is tapered for piercing the insulation from an insulated wire. The outer top edges of each slot 82 are preferably rounded and coined to provide a knife edge to easily pierce the insulation. Typically, the contact member 32 is plated with a corrosion resistant conductive material, such as hard brass or a phosphor bronze nickel.

Figure 5:
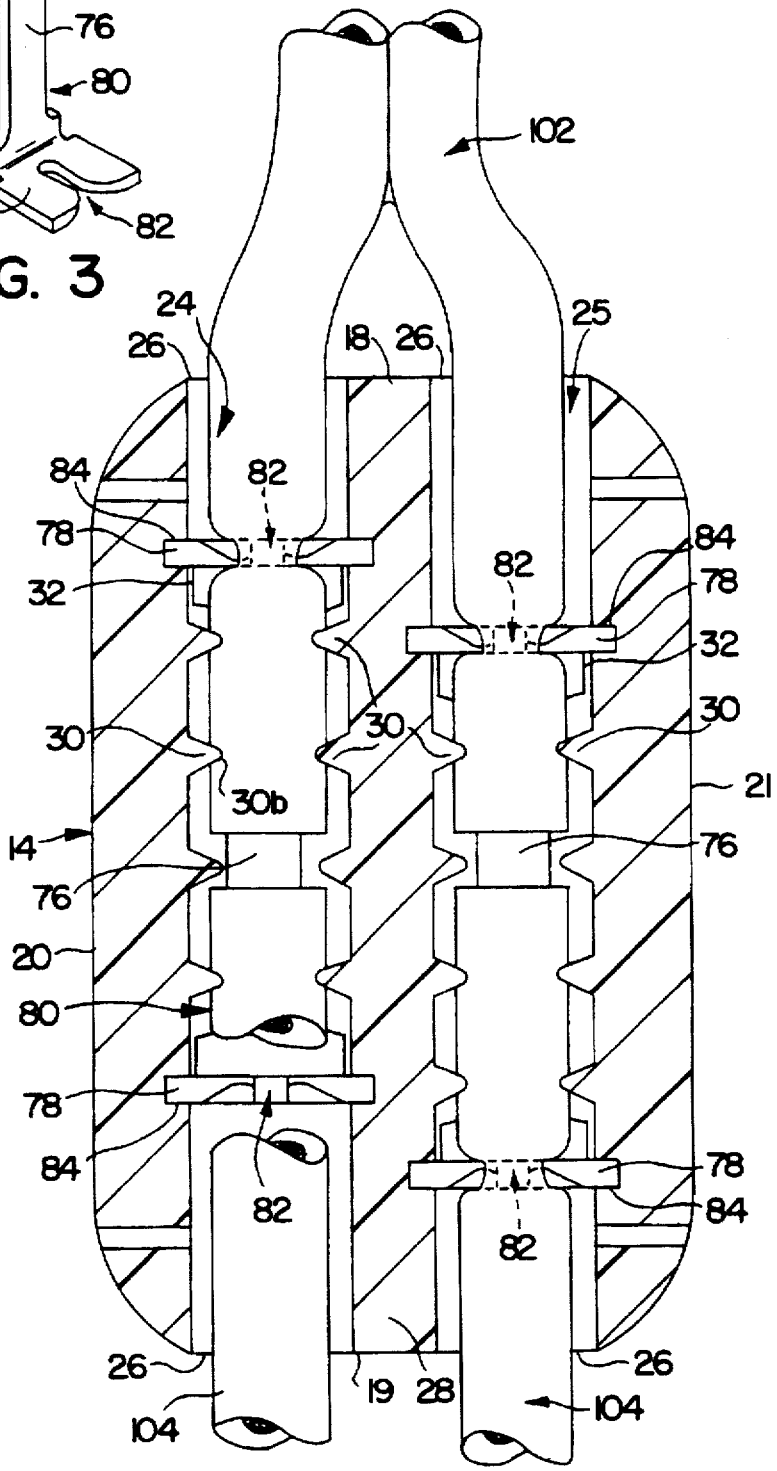
FIG. 5 is a cross-sectional view taken along line 5—5 of FIG. 4.

As best seen in FIGS. 4–6, contact member 32 is positioned in each of the channels 24 and 25. Two pairs of aligned grooves 84 are provided in the side walls of each channel 24 and 25 and are spaced to receive the edges of the end wall portions 78 of contact member 32. The contact members 32 are secured within the channels 24 and 25 by securing the edges of the end wall portions 78 in the grooves 84. The elongated notches 80 formed in the base portion 76 of each contact member 32 allow the contact members 32 to be placed within the channels 24 and 25 without interfering with the ribs 30. As seen in FIG. 5, each contact member 32 is longitudinally staggered within channels 24 and 25 so that the grooves 84 in the central wall 28 do not weaken the central wall 28.

As seen in FIG. 4, the bores 52 and 53 are tapered to facilitate insertion of an uninsulated wire therein. Also, the bottom of each channel 24 and 25 is provided with a recess 86 for receiving the base portion 76 of each contact member 32 so that the top surface of the base portion 76 is flush with the bottom surface of the channels.

The wire splice 10 is used to splice the conductors of wires 102 and 104 as follows. The insulated conductors of each length of wire 102 and 104 are separated to allow the ends of each conductor to be placed within the first housing section 14 as shown in FIG. 20. One conductor of wire 102 is placed into channel 24 and the other conductor is inserted into channel 25. Each conductor is placed within the channels 24 and 25 so that its end overlies the closer end wall portion 78 of the contact member 32 within the channel. (See FIG. 5). The conductors of wire 104 are positioned in a similar manner.

The second housing section 16 is then aligned with the first housing section 14 by aligning each upstanding retaining member 34 and 38 of the first housing section 14 with a respective groove 66 and recess 62 of the second housing section 16. When properly aligned, the housing sections can be pressed together.

As the housing sections 14 and 16 are pressed together, the elongated bosses 50, aligned with each channel 24 and 25, force the conductors of the wires 102 and 104 into the slots 82 of the contact members 32. As the conductors are pressed into the slots 82, the angled edges of the slots 82 pierce the insulation on the conductors so that the conductors make contact with the contact members 32. (See FIGS. 4 and 5). Eventually, as the housing sections 14 and 16 are further pressed together, the detents 36 of the upstanding members 34 will interengage the detents 64 of the recess 62, locking the housing sections together. In this manner, each conductor of wire 102 is electrically connected to one of the conductors of wire 104 through a contact member 32.

The wire splice 10 is also used to splice the uninsulated wires 106 and 108, typically a ground wire, as follows. The wire 106 can be inserted into either bore 52 or bore 53 of the second housing 16. As seen in the embodiment shown in FIG. 4, conductor wire 106 is inserted into bore 52 at end wall 42 until it passes through the cavity 54 and enters into the portion of bore 52 between the cavity 54 and end wall 43. Similarly, the wire 108 is inserted into bore 53 at end wall 43 so that each wire passes through the cavity 54 and enters into the portion of bore 53 between the cavity 54 and endwall 42. The wires 106 and 108 extend through cavity 54 in their respective bores to ensure that both sidewall portions 70 engage the wires.

The contact member 56 is inserted into the cavity 54 and pressed inwardly. Each pair of slots 72 in the sidewall portions 70 of the contact member 56 is aligned with one of the wires 106 and 108 as the contact member 56 is inserted into the cavity 54. As the contact member 56 is pressed inwardly, the angled (or tapered) edges of the slots 72 engage the uninsulated wires 106 and 108 so that they make electrical connection with the contact members 56. (See FIGS. 4 and 6). The contact member 56 is pressed into the cavity 54 until the sidewall portions 70 bottom out against the bottom surface of the cavity 54 and the outer surface of the base portion 76 is flush with the outer wall 46 of the second housing section. In this way, the wire 106 is electrically connected to the wire 108 through the contact member 56.

Thus, the wire splice 10 can be easily and quickly snapped together to electrically connect up to two separate lengths of insulated conductors and two separate uninsulated ground wires together without using any tools, and without requiring any special skills. It is understood that the present invention could be used to splice together two lengths of insulated single conductor wire if desired.

The present invention may be embodied in other specific forms without departing from the spirit or essential attributes thereof and, accordingly, reference should be made to the appended claims, rather than to the foregoing specification, as indicating the scope of the invention.

What is claimed is:

1. A device for electrically splicing wire comprising first and second nonconductive housing sections, the sections being adapted to be matingly secured together to form a substantially closed housing, a first opening in one of the housing sections in communication with the exterior of the housing for receiving a first insulated wire and a second opening in one of the housing sections in communication with the exterior of the housing for receiving a second insulated wire, a first electrically conductive contact within the housing having a first end including a tang for piercing the insulation of the first wire and making electrical contact with the center conductor thereof, a second end including a tang for piercing the insulating of the second wire and making electrical contact with the center conductor thereof, and a connecting portion electrically connecting the first end and the second end to provide an electrical path from the center conductor of the first wire through the first contact to the center conductor of the second wire, and at least one boss in the housing for pressing the ends of the first and second wires against the tangs of the first electrically conductive contact, when the housing sections are mated to one another, sufficient to cause the tangs to pierce the insulation and make electrical contact with the center conductors and to secure the ends within the housing;

a third opening in one of the housing sections in communication with the exterior of the housing for receiving an end of a first uninsulated conductive wire and a fourth opening in one of the housing section in communication with the exterior of the housing for receiving an end of a second uninsulated conductive wire, a fifth opening in one of the housing sections in communication with both the third and fourth openings for receiving therein a third electrically conductive contact having a first end including a tang making electrical contact with the first uninsulated wire, a second end including a tang for making electrical contact with the second uninsulated wire, and a connecting portion electrically connecting the first end and the second end of the third contact to provide an electrical path from the first uninsulated wire through the third contact to the second uninsulated wire.

2. A device for electrically splicing wire comprising first and second nonconductive housing sections, the sections being adapted to be matingly secured together to form a substantially closed housing, a first opening in one of the housing sections in communication with the exterior of the housing for receiving a first insulated wire and a second opening in one of the housing sections in communication with the exterior of the housing for receiving a second insulated wire, a first electrically conductive contact within the housing having a first end including a tang for piercing the insulation of the first wire and making electrical contact with the center conductor thereof, a second end including a tang for piercing the insulation of the second wire and making electrical contact with the center conductor thereof, and a connecting portion electrically connecting the first end and the second end to provide an electrical path from the center conductor of the first wire through the first contact to the center conductor of the second wire, and at least one boss in the housing for pressing the ends of the first and second wires against the tangs of the first electrically conductive contact, when the housing sections are mated to one another, sufficient to cause the tangs to pierce the insulation and make electrical contact with the center conductors and to secure the ends within the housing;

a chamber in the first housing, the first and second openings communicating with the chamber, the first contact being located within the chamber, the at least one boss being aligned with the chamber when the housing sections are mated;

a third opening in one of the housing sections in communication with the exterior of the housing for receiving a first uninsulated conductive wire and a fourth opening in one of the housing section in communication with the exterior of the housing for receiving a second uninsulated conductive wire, a fifth opening in one of the housing sections in communication with both the third and fourth openings for receiving therein a third electrically conductive contact having a first end including a tang for making electrical contact with the first uninsulated wire, a second end including a tang for making electrical contact with the second uninsulated wire, and a connecting portion electrically connecting the first end and the second end of the third contact to provide an electrical path from the first uninsulated wire through the third contact to the second uninsulated wire.

3. The device according to claim 2 further comprising a first bore and a second bore extending through the second housing section, the fifth opening being located in the second housing, the third opening communicating with the first bore, the fourth opening communicating with the second bore, the fifth opening communicating with both the first and second bores.

4. The device according to claim 2 further comprising at least one protrusion extending from one of the housing sections and at least one recess in the other housing section, each recess being adapted to receive one of the at least one protrusions for aligning the first and second housing sections.

5. The device according to claim 2 wherein the housing sections further comprise cooperative interengaging detents integral therewith for mateably securing the first and second housing sections together.

6. A device for electrically splicing wire comprising first and second nonconductive housing sections, the sections being adapted to be matingly secured together to form a substantially closed housing, a first opening in one of five housing sections in communication with the exterior of the housing for receiving a first insulated wire and a second opening in one of the housing sections in communication with the exterior of the housing for receiving a second insulated wire, a first electrically conductive contact within the housing having a first end including a tang for piercing the insulation of the first wire and making electrical contact with the center conductor thereof, a second end including a tang for piercing the insulation of the second wire and making electrical contact with the center conductor thereof, and a connecting portion electrically connecting the first end and the second end to provide an electrical path from the center conductor of the first wire through the first contact to the center conductor of the second wire, and at least one boss in the housing for pressing the ends of the first and second wires against the tangs of the first electrically conductive contact, when the housing sections are mated to one another, sufficient to cause the tangs to pierce the insulation and make electrical contact with the center conductors and to secure the ends within the housing a chamber in the first housing, the first and second openings communicating with the chamber, the first contact being located within the chamber, the at least one boss being aligned with the chamber when the housing sections are mated a second electrically conductive contact located within the chamber and having a first end including a tang for piercing the insulation of the third insulated wire and making electrical contact with the center conductor thereof, a second end including a tang for piercing the insulation of a fourth insulated wire and making electrical contact with the center conductor thereof, and a connecting portion electrically connecting the first end and the second end of the second contact to provide an electrical path from the center conductor of the third wire through the second contact to the center conductor of the fourth wire, whereby the at least one boss presses the ends of the third and fourth wires against the tangs of the second contact when the housing sections are mated to one another sufficient to cause the tangs of the second contact to pierce the insulation of the third and fourth wires and make electrical contact with the center conductors of the third and fourth wires and to secure the ends of the third and fourth wires within the housing;

a third opening for receiving the third wire and a fourth opening for receiving the fourth wire and wherein the chamber comprises a first elongated channel and a second elongated channel, the first channel connecting the first and second openings, the first contact being located within the first channel, the second channel connecting the third and fourth openings, the second contact being located within the second channel.

7. The device according to claim 6 wherein a plurality of ribs are formed on sidewalls of each channel for frictionally engaging a wire located in the channel.

8. The device according to claim 6 wherein the at least one boss is located in the second housing and includes a first boss and a second boss, the first boss being aligned with the first channel and the second boss being aligned with the second channel.

9. The device according to claim 8 further comprising a fifth opening in one of the housing sections in communication with the exterior of the housing for receiving first uninsulated wire and a sixth opening in one of the housing section in communication with the exterior of the housing for receiving a second uninsulated wire, a seventh opening in one of the housing sections in communication with both the fifth and sixth openings for receiving therein a third electrically conductive contact having a first end including a tang making electrical contact with the first uninsulated wire, a second end including a tang for making electrical contact with the second uninsulated wire, and a connecting portion electrically connecting the first end and the second end of the third contact to provide an electrical path from the first uninsulated wire through the third contact to the second uninsulated wire..

10. The device according to claim 9 further comprising a first bore and a second bore extending through the second housing section, the seventh opening being located in the second housing, the fifth opening communicating with the first bore, the sixth opening communicating with the second bore, the seventh opening communicating with both the first and second bores.

11. The device according to claim 9 wherein the first end and the second end of each contact are upstanding walls extending from the connecting portion and each tang of the first and second contacts has angled edges.

12. The device according to claim 11 wherein the third contact comprises another tang on each end wall aligned with the one tang on the opposite end wall, the first uninsulated and the second uninsulated wires each engaging one of the pairs of aligned tangs of the third contact.

13. A device for splicing two lengths of insulated two-conductor wire and two lengths of uninsulated single conductor wire, the device comprising:

a nonconductive housing comprising a first section and a second housing section, the second housing section being adapted to mateably engage the first housing section;

the first housing section having a pair of elongated channels extending longitudinally therethrough and extending through end walls of the first housing section for receiving respective ones of the conductors of one of the two conductor wires, a wall separating the channels, each channel being dimensioned to receive one conductor from each length of two conductor wire;

a first electrical contact in each channel for electrically connecting one of the conductors of one of two conductor wires to one of the conductors of the other two conductor wire, each first contact including an elongated base portion and a pair of wall portions extending from either end of the base portion, each wall portion including a slot for receiving an insulated conductor, the slot being angled for piercing the insulation of the insulated conductor and making electrical contact with the center conductor therein;

the second housing section comprising a pair of elongated bosses, a pair of longitudinally extending bores, a cavity formed in an outer wall of the second housing section extending transversely with respect to and in communication with each bore, each boss being aligned with one of the channels when the first and second housing sections are matingly engaged, each boss being dimensioned to enter a respective channel to press a wire into the slots of the electrical contact located therein, each bore having an opening at opposite end walls of the second housing section for receiving a respective one of the single conductor wires; and a second electrical contact disposed within the cavity of the second housing section and passing through each bore for electrically connecting one of the uninsulated single conductor wires to the other uninsulated single conductor wire, the second electrical contact comprising a base portion having a substantially U-shape and a pair of slots formed in each sidewall portion of the second contact, each pair of slots being aligned with each bore, each slot being tapered for making electrical contact with the uninsulated wire.

14. The device according to claim 13 wherein a plurality of ribs are formed on the sidewalls of each channel for frictionally engaging the insulated conductors within each channel.

15. The device according to claim 13 further comprising at least one protrusion extending from one of the housing sections and at least one recess in the other housing section, each recess being adapted to receive one of the at least one protrusions for aligning the first and second housing sections.

16. The device according to claim 13 wherein the housing sections further comprise cooperative interengaging detents integral therewith for mateably securing the first and second housing sections together.

17. A device for electrically splicing wire comprising first and second nonconductive housing sections, the sections being adapted to be matingly secured together to form a substantially closed housing, one of the housing sections receiving an end of a first insulated wire and an end of a second insulated wire, a first electrically conductive contact within the housing having a first end including a tang for piercing the insulation of the first wire and making electrical contact with the center conductor thereof, a second end including a tang for piercing the insulation of the second wire and making electrical contact with the center conductor thereof, and a connecting portion electrically connecting the first end and the second end to provide an electrical path from the center conductor of the first wire through the first contact to the center conductor of the second wire, and the other of the housing sections receiving an end of a first uninsulated conductive wire and an end of a second uninsulated conductive wire, a cavity in one of the housing sections in communication with both the first and second uninsulated conductive wires, the cavity receiving therein a third electrically conductive contact having a first end including a tang making electrical contact with the first uninsulated wire, a second end including a tang for making electrical contact with the second uninsulated wire, and a connecting portion electrically connecting the first end and the second end of the third contact to provide an electrical path from the first uninsulated wire through the third contact to the second uninsulated wire.

18. The device according to claim 17, further comprising at least one protrusion extending from one of the housing sections and at least one recess in the other housing section, each recess being adapted to receive one of the at least one protrusions for aligning the first and second housing sections.

19. The device according to claim 17, further comprising at least one boss in the housing for pressing the ends of the first and second insulated wires against the tangs of the first electrically conductive contact, when the housing sections are mated to one another, sufficient to cause the tangs to pierce the insulation and make electrical contact with the center conductors and to secure the ends within the housing.

20. The device according to claim 19, further comprising a chamber in the one housing, the first contact being located within the chamber, the at least one boss being aligned with the chamber when the housing sections are mated.

* * * * *